US006877192B2

(12) United States Patent
Tominaga et al.

(10) Patent No.: US 6,877,192 B2
(45) Date of Patent: Apr. 12, 2005

(54) SLIDE FASTENER AND MANUFACTURING METHOD THEREOF

(75) Inventors: Yutaka Tominaga, Toyama-ken (JP); Toshiaki Takizawa, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/058,405

(22) Filed: Jan. 30, 2002

(65) Prior Publication Data

US 2002/0100148 A1 Aug. 1, 2002

(30) Foreign Application Priority Data

Jan. 31, 2001 (JP) ..... 2001-023927

(51) Int. Cl.[7] ..... A44B 19/00
(52) U.S. Cl. ..... 24/381; 24/391; 24/396
(58) Field of Search ..... 24/381, 391, 396, 24/398; 190/903

(56) References Cited

U.S. PATENT DOCUMENTS

| | | | | |
|---|---|---|---|---|
| 2,288,105 A | | 6/1942 | Plotkin | |
| 2,658,543 A | * | 11/1953 | Budnick | 150/118 |
| 3,443,671 A | * | 5/1969 | Dyke | 190/103 |
| 3,925,858 A | | 12/1975 | Thaeler | |
| 4,083,089 A | * | 4/1978 | Minami | 24/381 |
| 4,651,389 A | * | 3/1987 | Yoshida et al. | 24/433 |
| 4,906,310 A | | 3/1990 | Broderick et al. | |
| 5,111,919 A | * | 5/1992 | Hamatani et al. | 190/109 |
| 5,129,127 A | * | 7/1992 | Hamatani | 24/394 |
| 5,813,094 A | * | 9/1998 | Perez, II | 24/381 |
| 6,345,709 B1 | * | 2/2002 | Cheng | 190/119 |

FOREIGN PATENT DOCUMENTS

| | | | | |
|---|---|---|---|---|
| DE | 42 12 209 A1 | | 10/1993 | |
| EP | 0 875 167 A2 | | 11/1998 | |
| GB | 802981 | | 10/1958 | |
| JP | 04129502 A | * | 4/1992 | A44B/19/42 |
| JP | 5-65166 | | 6/1992 | |

* cited by examiner

*Primary Examiner*—James R. Brittain
(74) *Attorney, Agent, or Firm*—Finnegan, Henderson, Farabow, Garrett & Dunner, L.L.P.

(57) ABSTRACT

Both sides of a fastener chain may be reinforced and an attachment object such as a bag or a case may be mounted in a stabilized condition. A reinforcement member, which is molded of thermoplastic resin, thermoplastic elastomer or synthetic rubber in the form of a turned-down U shape in its cross section and has an appropriate plasticity and flexibility, is bonded along both outer sides of a fastener chain with a thermal welding resin film. The reinforcement member has a mounting groove which enables a cloth of the attachment object such as the bag or the case to be mounted and further contains a concave groove for a sewing thread, provided in the surface thereof. The cloth of the attachment object is inserted into the mounting groove and sewed along the concave groove with a sewing thread. Consequently, the reinforcement member can be mounted simply in a stabilized condition and can ensure a long term use.

2 Claims, 6 Drawing Sheets

SLIDE FASTENER AND MANUFACTURING METHOD THEREOF

BACKGROUND OF THE INVENTION

1. Field of the Invention

The present invention relates to a slide fastener for use in a case, bag and the like, whose small size one being used in, for example, a business case, shoulder bag and large size one being used in an opening of a suite case, and a manufacturing method thereof.

2. Description of the Related Art

Conventionally, when the slide fastener is attached to an opening of a case, a bag or the like, an end portion of a cloth of an attachment object such as the case and bag is folded back and a fastener tape is sewed thereto or the fastener tape is sewed with beading lying between the cloth and the fastener tape. However, the sewing operation is troublesome.

Then, as shown in FIG. 7, Japanese Patent Application Publication No. 5-65166 has disclosed a following mechanism. That is, right and left side plates 30' are formed of rubber or thermoplastic resin such that each of their cross sections indicates S shape so as to form inward and outward folded-back groove portions 31' and 8'. Then, an outer edge portion of each of the right/left fastener tapes 2' is inserted into the inward folded-back groove portion 31', and pressed and fitted. Further a cloth 16' of the opening edge portion of a bag is inserted into the outward folded-back groove portion 8' and sewed together with the side plate 30' so as to form the opening of the bag.

In the slide fastener for use in the opening of the bag shown in FIG. 8, the fastener tape 2' is fixed to the side plates 30' by pressing and fitting on the extrusion mold of the side plates 30'. In the fixing operation by pressing and fitting, the fastener tape 2' can be fixed firmly when resin for forming the side plate 30' penetrates into weave pattern of the fastener tape 2'. However, it is difficult to make resin penetrate into the weave pattern of the fastener tape 2' and even if the fastener tape 2' is fixed, it is likely to be separated easily. Further, the molded side plate 30' has three layers of a thick structure and therefore, the sewing operation is hard to execute.

SUMMARY OF THE INVENTION

The invention has been achieved in views of the above-described problem and therefore, an object of a main aspect of the invention is to provide a slide fastener in which both sides of a fastener chain are reinforced, an attachment object may be mounted to a fastener tape in a stable condition. Therefore, more specifically, the object of the invention is to provide a good-appearance, and strongly-built slide fastener in which the reinforcement member made of thermoplastic resin is bonded to the fastener tape easily and firmly.

Another object of the invention is to provide a slide fastener which is equipped with various kinds of reinforcement members depending on an attachment style to the attachment object and can be attached to the attachment object in a stable condition.

Still another object of the invention is to provide a slide fastener in which by specifying an adhesive agent for fixing the reinforcement member to the fastener tape, attachment of a high fixing strength can be obtained.

Further object of the invention is to provide a manufacturing method of a slide fastener which enables a reinforcement member and a fastener tape to be bonded with each other firmly and simply using a thermal welding resin film.

To achieve the above-described objects, according to the invention, a reinforcement member is bonded to a fastener tape along both outer sides of a fastener chain. Consequently, both the outer sides of the fastener chain are reinforced and the attachment object can be mounted to the fastener tape in a stabilized condition. Further, this fastener tape can bear a long-term use and the reinforcement member and the fastener tape can be bonded with each other easily and firmly, so that they are not separated easily.

Preferably, the reinforcement member to be bonded to the fastener tape contains a concave mounting groove, in which an attachment object is to be inserted, the concave mounting groove being provided in a side face thereof. Consequently, an end portion of an attachment object such as a bag or a case is protected and the attachment can be mounted to the reinforcement member easily.

Alternately, there is provided the slide fastener according to the first aspect, wherein the rear face of the reinforcement member to be bonded to the fastener tape is a flat bonding face. Consequently, the attachment object such as the bag and or the case can be mounted to the fastener chain provided with the reinforcement member in a stabilized condition.

Preferably, the reinforcement member and the fastener tape are bonded with each other with a thermal welding resin film as a bonding member. Consequently, the reinforcement member can be bonded to the fastener tape equally without any unevenness along the longitudinal direction of the fastener chain and further, a high bonding strength can be obtained.

Further preferably, a manufacturing method of a slide fastener comprises the steps of: molding a reinforcement member continuously; and disposing a thermal welding resin film between the reinforcement member maintained at a high temperature and a fastener tape, the thermal welding resin film having a lower melting point, and bonding the reinforcement member with the fastener tape. Consequently, the reinforcement member can be bonded to the fastener chain equally at a high bonding strength along the longitudinal direction of the fastener chain through a simple process.

And further, the manufacturing method of the slide fastener further comprising a step of attaching the thermal welding resin film to a surface of the fastener tape by welding or sticking. Consequently, the thermal welding resin film, which is to be disposed between the reinforcement member and the fastener tape, does not have to be positioned specially and the reinforcement member can be bonded to the fastener tape securely.

Still further, the thermal welding resin film has a separation film provided on the surface thereof, the manufacturing method further comprises a step of peeling off the separation film after water-repellent treatment is performed to the fastener tape before bonding the reinforcement member and the fastener tape. Consequently, when the fastener tape is subjected to water repellent finish processing, no water-repellent material adheres to the thermal welding resin film, thereby preventing adhesion of the thermal welding resin film from dropping. As described above, the effects which the present invention achieves are very conspicuous.

DESCRIPTION OF THE PREFERRED EMBODIMENTS

Hereinafter, the preferred embodiments of a slide fastener of the invention will be described in detail with reference to the accompanying drawings.

Figure 1:
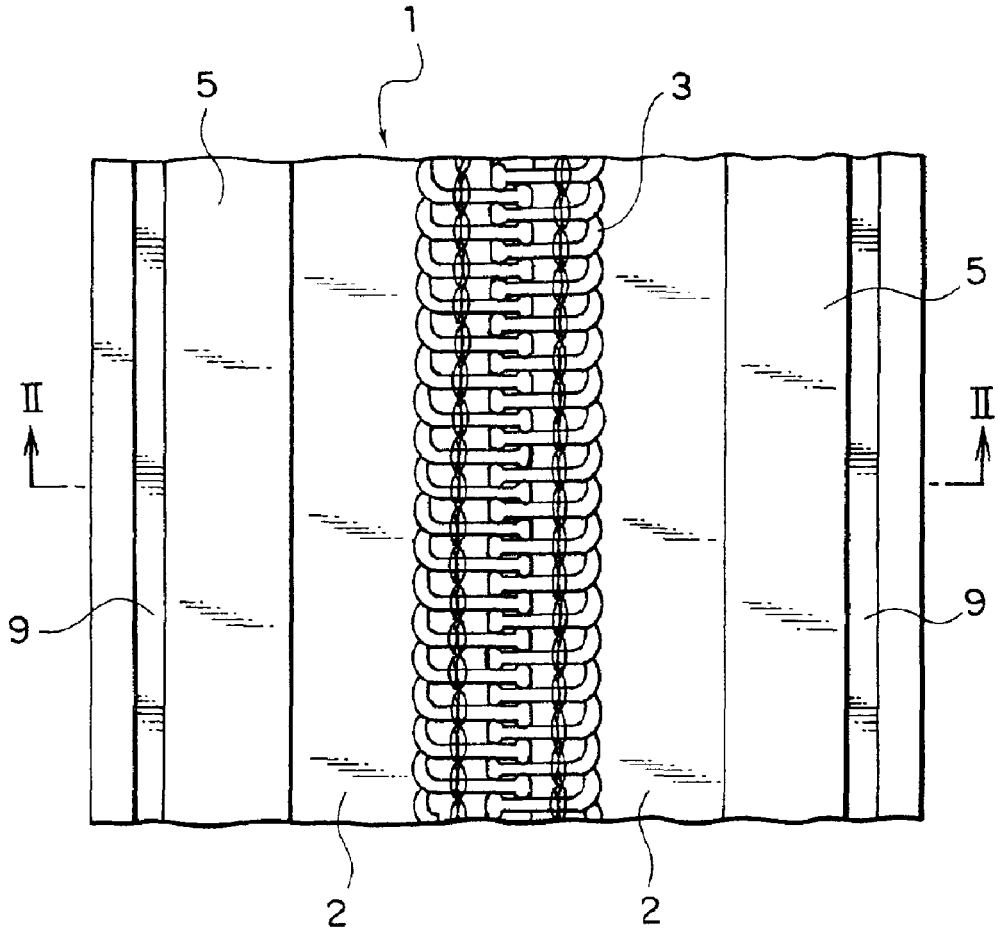
FIG. 1 is a front view of a slide fastener.
Figure 2:
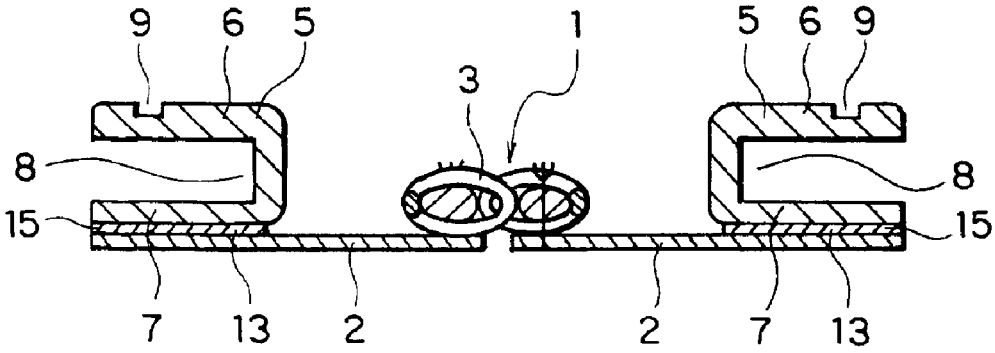
FIG. 2 is a sectional view taken along the lines II—II in FIG. 1, of the same slide fastener.

According to the slide fastener of the invention, as shown in FIGS. 1 and 2, in a fastener chain 1, fastener elements 3 each having an appropriate configuration are attached along a side edge in a longitudinal direction of the fastener tape 2 by sewing or the like and a reinforcement member 5 made of thermoplastic resin whose cross section indicates turned-down U shape is bonded along the other side edge in the longitudinal direction of the fastener tape 2 so as to form a bonding layer 15. As the bonding member, a thermal welding resin film 13 is used and attached continuously along the other side edge of the surface of the fastener tape 2 in the longitudinal direction thereof. Meanwhile, it is permissible to dispose the reinforcement member inside of the other side edge of the fastener tape.

The reinforcement member 5 is molded of ordinary thermoplastic resin or thermoplastic elastomer, or rubber material and has an appropriate plasticity and flexibility. The reinforcement member 5 contains a concave mounting groove 8 whose side face is open so that an end portion of an attachment object 16 such as a bag or a case can be inserted between opposing upper piece 6 and lower piece 7. To insert and fix the attachment object 16 in this mounting groove 8, a concave groove 9 for guiding a sewing thread is provided in the surface of the upper piece 6. A rear face of the lower piece 7 forms a flat bonding face.

Figure 3:
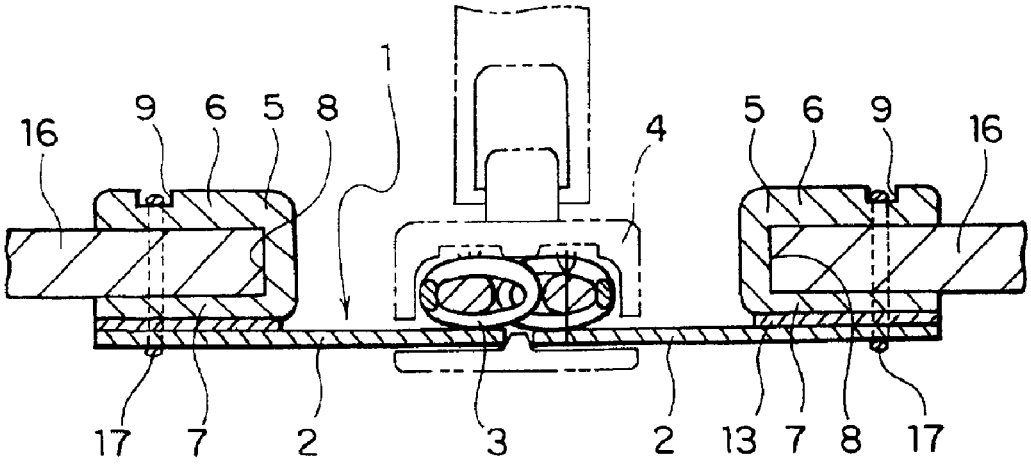
FIG. 3 is a sectional view showing a condition in which the same slide fastener is attached to an attachment object.
Figure 4:
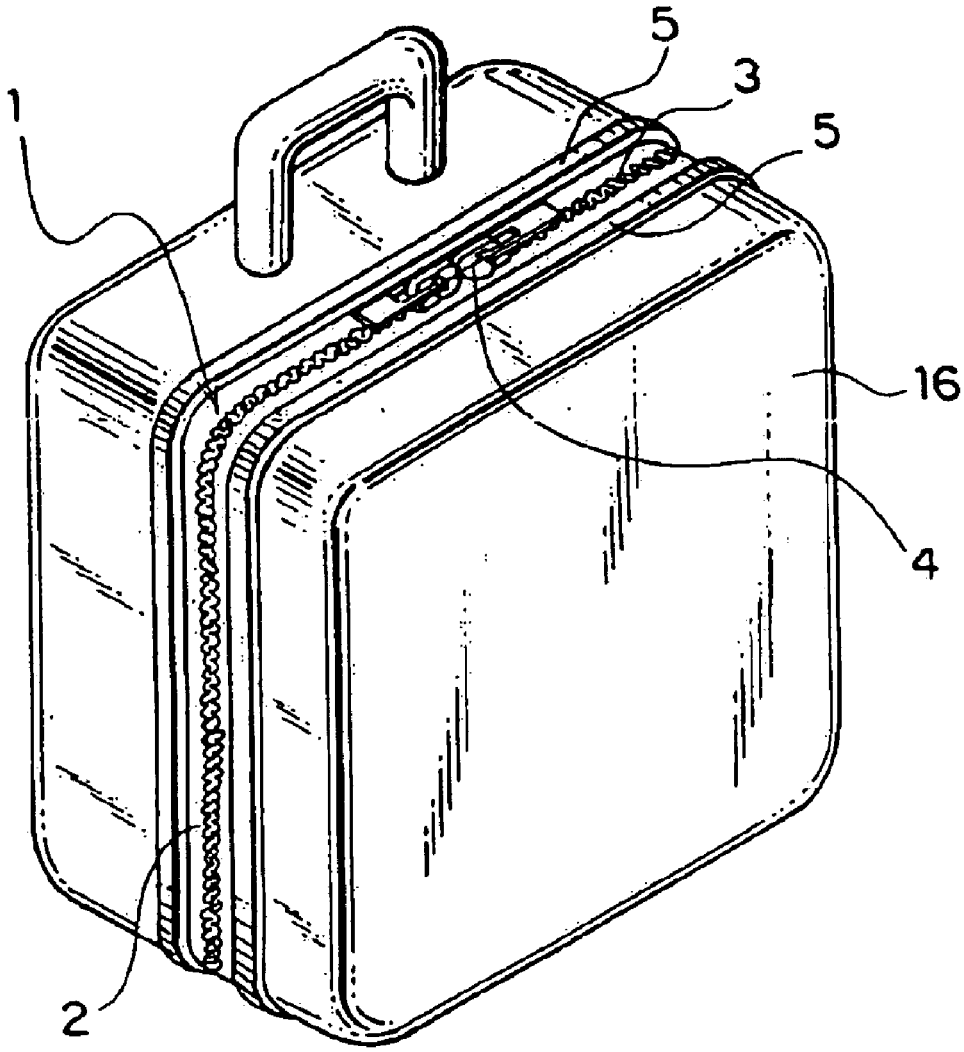
FIG. 4 is a perspective view showing a use condition of the same slide fastener.

According to the use condition of the slide fastener with this reinforcement member 5, as shown in FIG. 3, the reinforcement member 5 is bonded to the surface of the fastener tape 2 along each of both outer side edges of the fastener chain 1 via the thermal welding resin film 13. An end portion of an attachment object 16 such as the bag or the case shown in FIG. 4 is inserted into the mounting groove 8 provided between the upper piece 6 and the lower piece 7 of the reinforcement member 5 and the attachment object 16 is sewed with a sewing thread 17 along the concave groove 9 for guiding the sewing thread formed in the surface of the upper piece 6.

The fastener chain 1 on which the reinforcement member 5 is bonded is sewed to the attachment object 16 such as the bag or the case with sewing thread 17 along the concave groove 9 for guiding the sewing thread formed in the surface of the reinforcement member 5 such that the surface of the attachment object 16 is brought into contact with the rear face of the reinforcement member 5.

Alternately, a rear face of the reinforcement member 5 is formed entirely in the form of a flat bonding face without providing the reinforcement member 5 with any special structure for accommodating the attachment object or the fastener tape, unlike the above described embodiment and then, the fastener tape 2 is bonded to this flat surface by heating the thermal welding resin film 13 with a pressure. An end portion of the attachment object 16 such as the bag, case or the like is brought into contact with the fastener tape 2 on the rear face of the reinforcement member 5 and the attachment object 16 may be sewed along the concave groove 9 formed in the surface of the reinforcement member 5 with the sewing thread 17.

Figure 5:
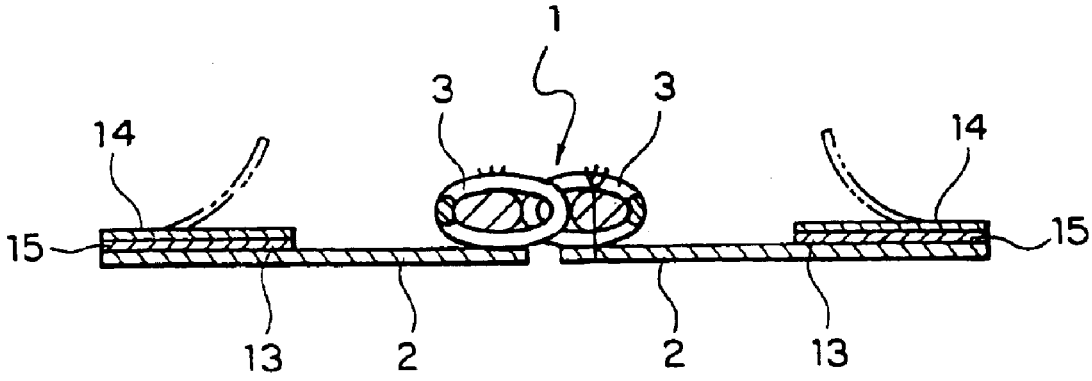
FIG. 5 is a sectional view showing a condition before a reinforcement member is bonded to the fastener chain.

The slide fastener bonded to the reinforcement member 5 needs to be performed with water-repellent treatment with water-repellent material such as silicone if it is used in, for example, a water-proof case or the like. In this case, before the reinforcement member 5 is bonded to the fastener tape 2 as shown in FIG. 5, the thermal welding resin film 13 covered with a separation film 14 is attached to the surface of the fastener tape 2. This fastener chain 1 is dipped into a treatment bath containing water-repellent material so as to perform water-repellent treatment to the fastener tape 2 and the fastener elements 3. After this water-repellent treatment is performed, the separation film 14 is peeled off. Consequently, any water-repellent material which blocks adhesion is not attached to the surface of the thermal welding resin film 13 so as to bond the fastener tape 2 to the reinforcement member 5 firmly. Meanwhile, the water-repellent material may be sprayed to the fastener chain 1 with a spray nozzle so as to perform the water-repellent treatment.

The bonding member for bonding the fastener tape 2 to the reinforcement member 5 is not restricted to the thermal welding resin film. A thermal welding synthetic fiber yarn may be woven in the side edge of the fastener tape as a warp or knitted in as a warp knitted yarn or the thermal welding resin film may be woven or knitted into the side edge of the fastener tape so as to form the fastener tape. When bonding the reinforcement member, it may be bonded by heating with a pressure. Further, it is permissible to spray emulsion type adhesive agent as an adhesive bond with a spray nozzle just before bonding the reinforcement member.

Figure 6:
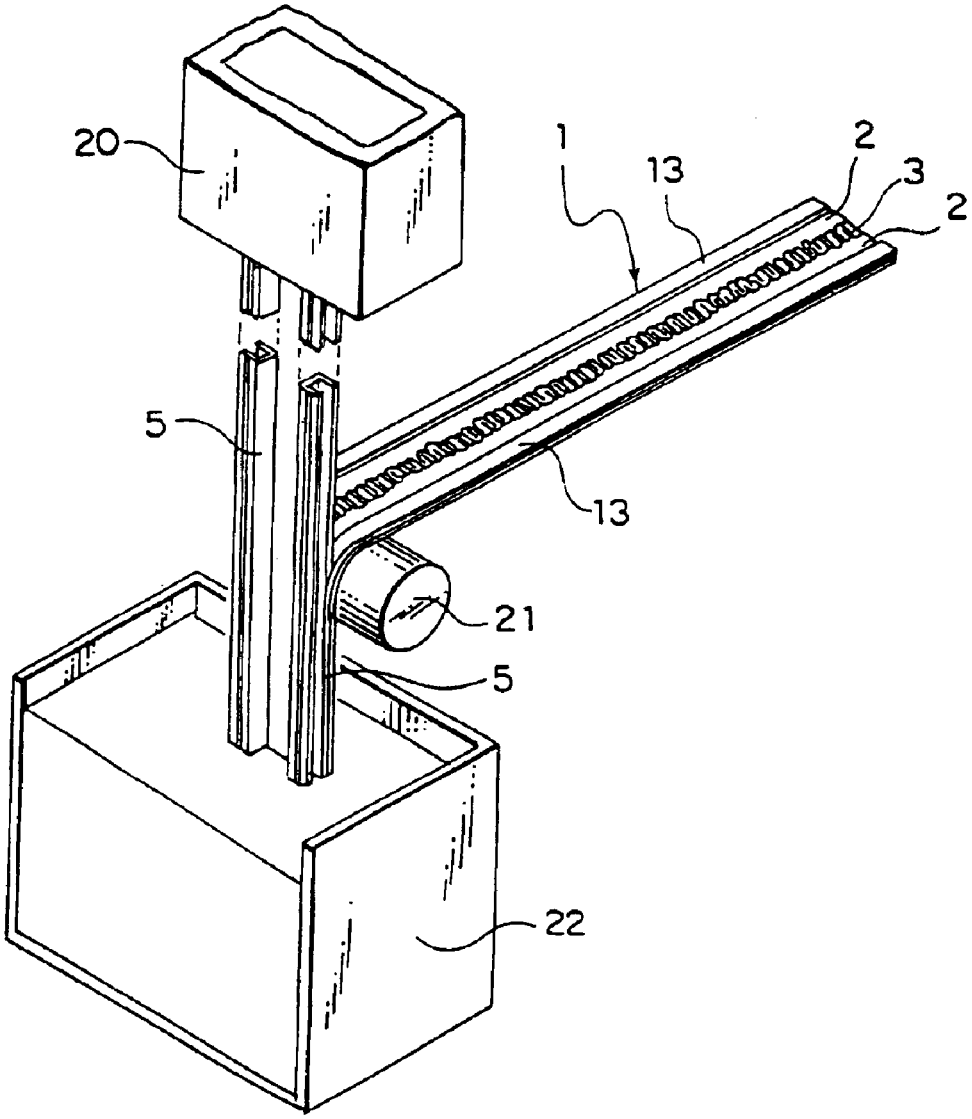
FIG. 6 is a schematic perspective view showing a manufacturing process of the slide fastener.
Figure 7:
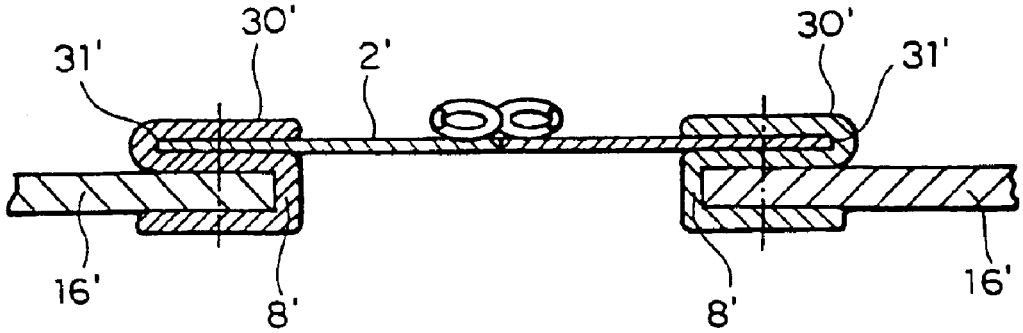
FIG. 7 (PRIOR ART)
FIG. 7 is a sectional view of a well-known slide fastener.

"Next, the manufacturing method of the slide fastener of the invention will be described. As shown in FIG. 6, vinyl chloride resin containing nitrile rubber is extruded out of an extruding die 20 of an extrusion molding machine using and the reinforcement member 5 having an appropriate shape is molded and transferred to a pressing roll 21. A melting temperature of the reinforcement member 5 at the extruding and pressing time thereof is about 180 to 200°. On the other hand, in the continuous fastener chain 1, the thermal welding resin film 13 made of modified polyester resin having a thickness of 60 $\mu$, width of 10 mm, and melting point of 130 to 140° C. is fused to both side edges of the surface of the fastener tape 2 by heating with pressure and then, the fastener tape 2 is transferred in a condition in which this thermal welding resin film 13 is exposed on the surface of the continuous fastener chain 1. The temperature of the reinforcement member 5 extruded from the extruding die 20 is set to about 150° on the pressing roll 21. While the reinforcement member 5 maintains a high temperature, the thermal welding resin film 13 attached to the fastener chain 1 is pressed by the pressing roll 20, so that the thermal welding resin film 13 is melted by heat from the reinforcement member 5 so as to bond the reinforcement member 5 with the fastener tape 2. After the bonding, the continuous fastener chain 1 is transferred to a cooling water bath 22 and cooled there. Consequently, the fastener chain 1 having the reinforcement member 5 is completed. Instead of fusing the thermal welding resin film to the fastener tape, it is permissible to paste the thermal welding film to a fastener tape having adhesiveness. Alternatively, it is permissible to transfer the thermal welding resin film separately from the fastener tape to the pressing roll and introduce it to between the fastener tape and the reinforcement member when both merge.

What is claimed is:

1. A slide fastener, wherein a reinforcement member is bonded to a fastener tape continuously along both outer sides of a fastener chain with a thermal welding resin film attached to the fastener tape continuously in a longitudinal direction thereof;

wherein the reinforcement member contains a concave mounting groove at least partially defined between an upper piece and a lower piece of the reinforcement member, and wherein the concave mounting groove is capable of receiving an attachment object;

wherein a concave groove for guiding a sewing thread is provided in a surface of the upper piece, and wherein a rear face of the lower piece forms a bonding face to the fastener tape; and wherein the upper piece of the reinforcement member extends higher than a surface of the fastener elements attached to a center of the fastener chain.

2. A slide fastener according to claim 1, wherein the rear face of the reinforcement member is a flat bonding face.

* * * * *